US010188211B1

(12) United States Patent
Whidden

(10) Patent No.: US 10,188,211 B1
(45) Date of Patent: Jan. 29, 2019

(54) PORTABLE, MODULAR SEATING SYSTEM AND RELATED METHODS

(71) Applicant: TOTALLY MOD EVENTS, LLC, Orlando, FL (US)

(72) Inventor: William L. Whidden, Orlando, FL (US)

(73) Assignee: TOTALLY MOD EVENTS, LLC, Orlando, FL (US)

( * ) Notice: Subject to any disclaimer, the term of this patent is extended or adjusted under 35 U.S.C. 154(b) by 183 days.

(21) Appl. No.: 15/081,109

(22) Filed: Mar. 25, 2016

Related U.S. Application Data

(60) Provisional application No. 62/139,583, filed on Mar. 27, 2015.

(51) Int. Cl.

| | |
|---|---|
| ***A47C 31/00*** | (2006.01) |
| ***A47C 7/70*** | (2006.01) |
| ***A47C 1/124*** | (2006.01) |
| ***A47C 4/02*** | (2006.01) |
| ***A47C 1/12*** | (2006.01) |

(52) U.S. Cl.
CPC ..... *A47C 1/124* (2013.01); *A47C 1/12* (2013.01); *A47C 4/02* (2013.01); *A47C 4/024* (2013.01); *A47C 4/028* (2013.01); *A47C 7/70* (2013.01); *A47C 31/003* (2013.01)

(58) Field of Classification Search
CPC ..... A47C 1/124; A47C 13/005; A47C 4/02; A47C 4/021; A47C 4/028; A47C 31/003
See application file for complete search history.

(56) References Cited

U.S. PATENT DOCUMENTS

| | | | | |
|---|---|---|---|---|
| 3,022,110 A * | 2/1962 | Brown | A47C 11/00 | 297/248 |
| 3,233,942 A * | 2/1966 | Creutz | A47B 85/00 | 297/118 |
| 3,874,729 A * | 4/1975 | Blodee | A47C 4/022 | 297/411.44 |
| 4,311,337 A * | 1/1982 | Brunn | A47C 13/005 | 297/135 |
| 4,657,302 A * | 4/1987 | Snyder | A47C 1/124 | 108/64 |
| 4,848,833 A * | 7/1989 | Grall | A47C 7/70 | 297/155 |
| 5,277,476 A * | 1/1994 | Caldwell | A47C 4/028 | 297/218.3 |
| 6,102,481 A * | 8/2000 | Tateyama | B29C 44/1252 | 297/411.41 |
| 6,264,272 B1 * | 7/2001 | Jones | A47C 7/70 | 297/173 |
| 7,370,910 B2 * | 5/2008 | Piretti | A47C 7/70 | 297/162 |

(Continued)

*Primary Examiner* — Timothy J Brindley
(74) *Attorney, Agent, or Firm* — Allen Dyer Doppelt & Gilchrist

(57) ABSTRACT

A modular seating system includes a plurality of side frames, seat back assemblies and seat bottom assemblies. Each of the side frames includes a base member configured to support the side frame on an underlying surface and an arm member extending upwardly from the base member. Each of the seat back assemblies and seat bottom assemblies are releasably connected between an adjacent pair of side frames. In use, the plurality of side frames are placed, freestanding, on an underlying surface. The plurality of seat back assemblies and seat bottom assemblies are then releasably connected therebetween to form a plurality of seats.

17 Claims, 4 Drawing Sheets

(56) References Cited

U.S. PATENT DOCUMENTS

| | | | | |
|---|---|---|---|---|
| 7,695,061 | B2 * | 4/2010 | Olarte | A47C 7/70 297/162 |
| 7,708,345 | B2 * | 5/2010 | Grabowski | A47C 4/02 297/354.12 |
| 9,456,693 | B1 * | 10/2016 | Broughton | A47B 47/0033 |
| 2005/0146178 | A1 * | 7/2005 | Hergesell | A47C 1/124 297/239 |
| 2006/0103180 | A1 * | 5/2006 | Brown | A47C 7/70 297/162 |
| 2010/0090504 | A1 * | 4/2010 | Brink | A47C 1/121 297/162 |
| 2011/0101740 | A1 * | 5/2011 | Koh | A47C 7/70 297/162 |
| 2011/0298256 | A1 * | 12/2011 | Suprina | A47C 1/12 297/232 |
| 2012/0299348 | A1 * | 11/2012 | Kusch | A47C 1/124 297/232 |
| 2013/0234576 | A1 * | 9/2013 | Hixson | A47C 13/005 312/265.5 |
| 2014/0252836 | A1 * | 9/2014 | Olarte | A47C 1/121 297/445.1 |
| 2015/0054322 | A1 * | 2/2015 | Jacobs | A47C 1/12 297/217.1 |
| 2015/0296986 | A1 * | 10/2015 | Rogers | A47C 1/124 297/239 |
| 2016/0095434 | A1 * | 4/2016 | Lin | A47B 87/007 24/517 |
| 2016/0262542 | A1 * | 9/2016 | Chung | A47C 13/005 |
| 2016/0374470 | A1 * | 12/2016 | Wu | A47B 83/001 297/135 |
| 2017/0055710 | A1 * | 3/2017 | Sewell | A47C 4/028 |
| 2017/0112286 | A1 * | 4/2017 | Griggs, Jr. | A47C 4/028 |

* cited by examiner

PORTABLE, MODULAR SEATING SYSTEM AND RELATED METHODS

CROSS REFERENCE TO RELATED APPLICATION

This application claims the benefit of U.S. Provisional Patent Application Ser. No. 62/139,583, filed on Mar. 27, 2015, the contents of which are herein incorporated by reference in their entirety.

FIELD OF THE INVENTION

The present invention relates to portable, modular seating, and more particularly, to portable, modular seating systems for conventions, trade shows, conferences and the like.

BACKGROUND OF THE INVENTION

Event venues, such as convention centers and hotels, frequently do not have permanently installed seating within meeting and exhibition spaces. This allows for more flexible configuration of such spaces by event organizers and exhibitors. Accordingly, portable seating must be brought in when desired. Various styles of folding or stacking chairs are well known for use in such situations. While these can score high for portability and installation, such chairs often earn poor marks for comfort and aesthetics.

Significant improvements in comfort, appearance and design flexibility can be offered by portable, modular furniture, such as is disclosed in the present inventor's U.S. Pat. No. 8,714,652, the contents of which are herein incorporated by reference in their entirety. While existing modular seating offers several advantages over folding or stacking chairs, further improvements are possible.

SUMMARY OF THE INVENTION

In view of the foregoing, it is an object of the present invention to provide improved portable, modular seating systems and related methods. According to an embodiment of the present invention, a modular seating system includes a plurality of side frames, seat back assemblies and seat bottom assemblies. Each of the side frames includes a base member configured to support the side frame on an underlying surface and an arm member extending upwardly from the base member. Each of the seat back assemblies and seat bottom assemblies are releasably connected between an adjacent pair of side frames.

According to a method aspect, a method of using the modular seating system includes placing a plurality of freestanding side frames on an underlying surface, and releasably connecting the plurality of seat back assemblies and the plurality of seat bottom assemblies between the plurality of freestanding side frames to form a plurality of seats.

According to an aspect of the present invention, each of the side frames further includes a back assembly channel bracket on a rear side of the arm member, the back assembly channel bracket defining channels in which lower frame legs of adjacent seat back assemblies are received. According to other aspects of the present invention, armrest pads and desk assemblies are connected to upper surfaces of some or all of the side frames.

These and other objects, aspects and advantages of the present invention will be better appreciated in view of the drawings and following detailed description of preferred embodiments.

DETAILED DESCRIPTION OF PREFERRED EMBODIMENTS

Figure 1:
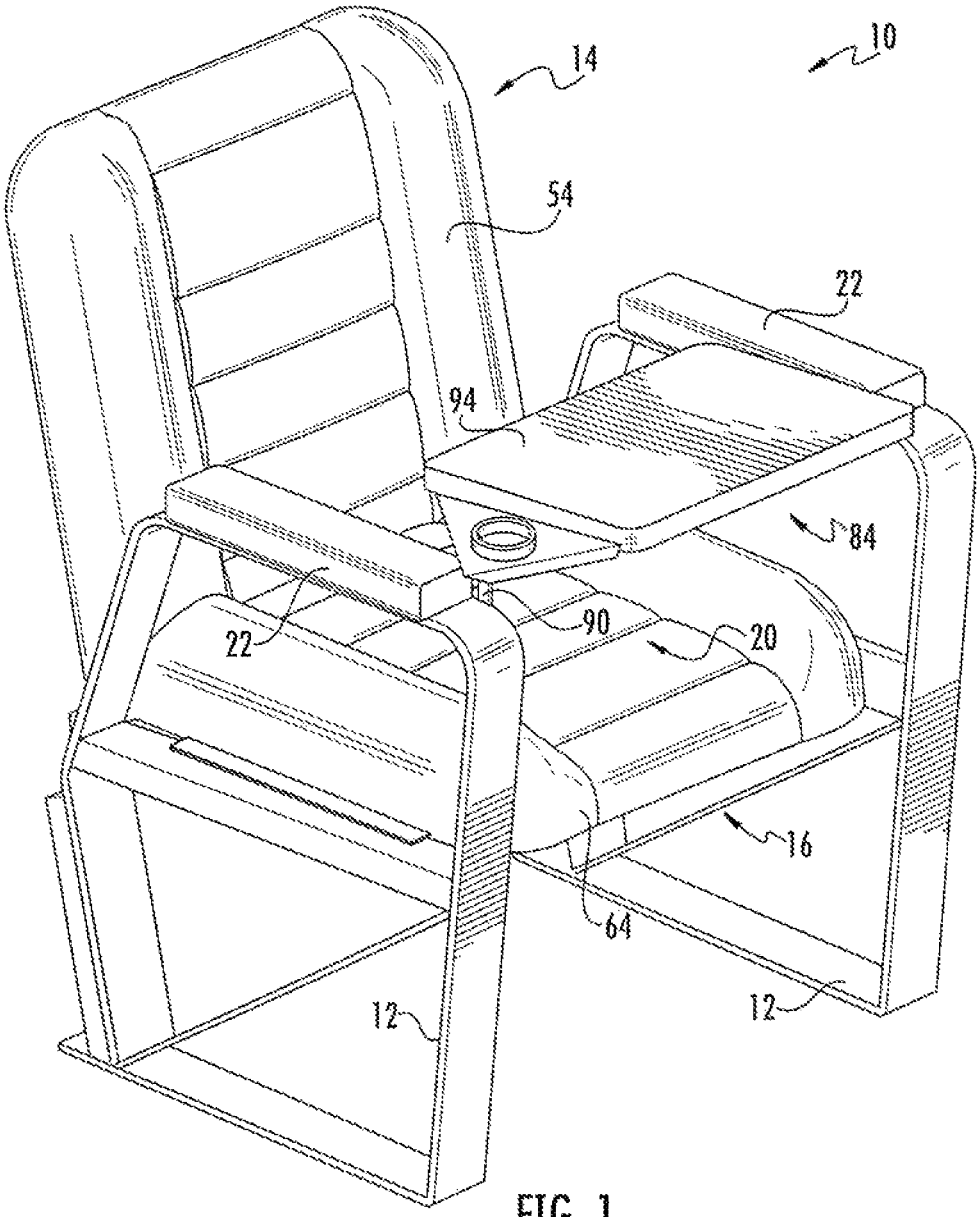
FIG. 1 is a perspective view of a modular seating unit of a modular seating system, according to an embodiment of the present invention.
Figure 2:
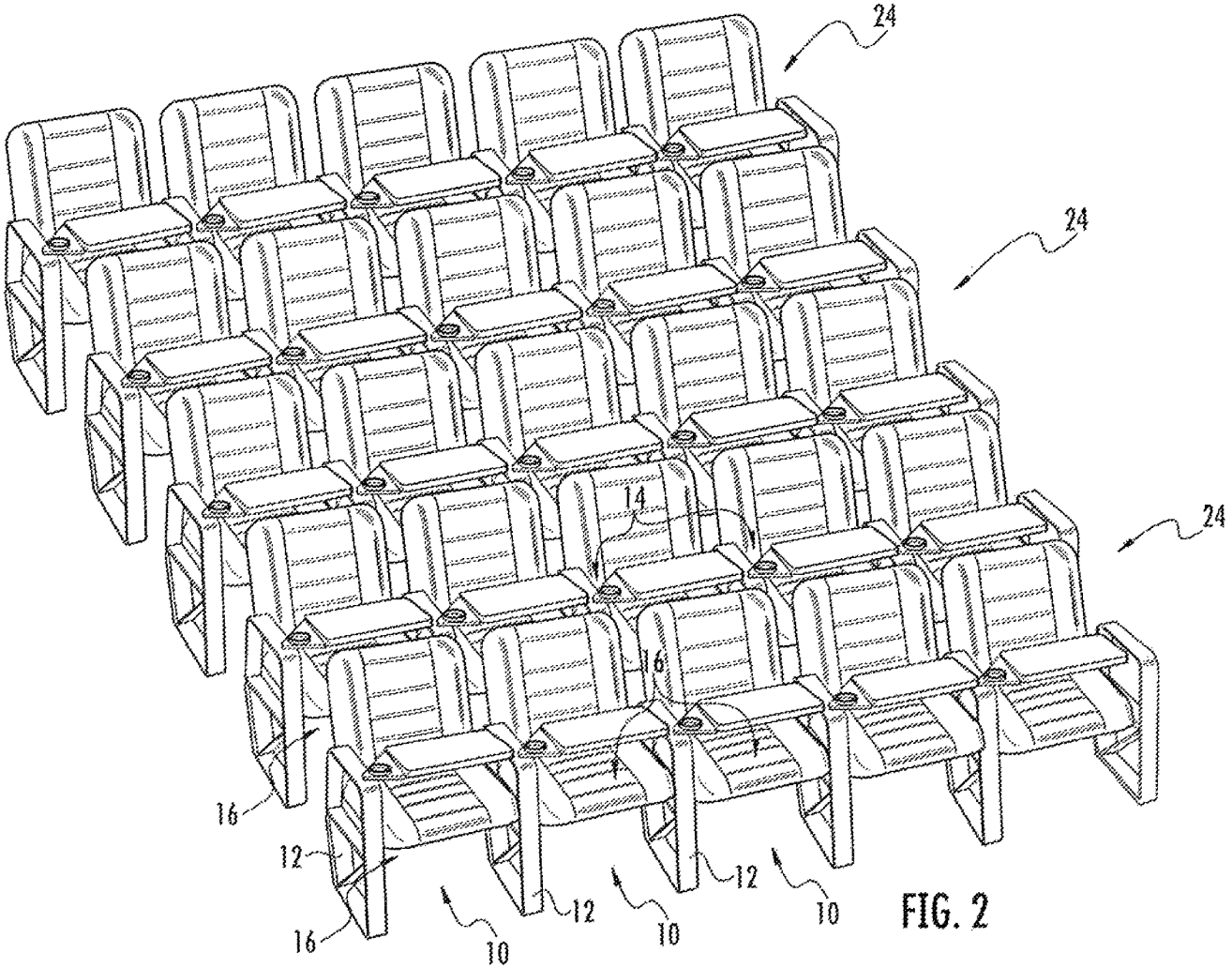
FIG. 2 is a perspective view of multiple rows of a modular seating system formed with the modular seating unit of FIG. 1.

Referring to FIG. 1, a modular seating unit 10 for seating system includes side frames 12 with a seat back assembly 14 and a seat bottom assembly 16 extending therebetween and removable therefrom. Advantageously, the seating unit 10 can further include a desk assembly 20 and armrest pads 22. Referring to FIG. 2, rows 24 of seating units 10 are easily assembled from a plurality of side frames 12, with the seat back and seat bottom assemblies 14, 16 of adjacent seating units 10 sharing a common side frame 12.

Figure 3:
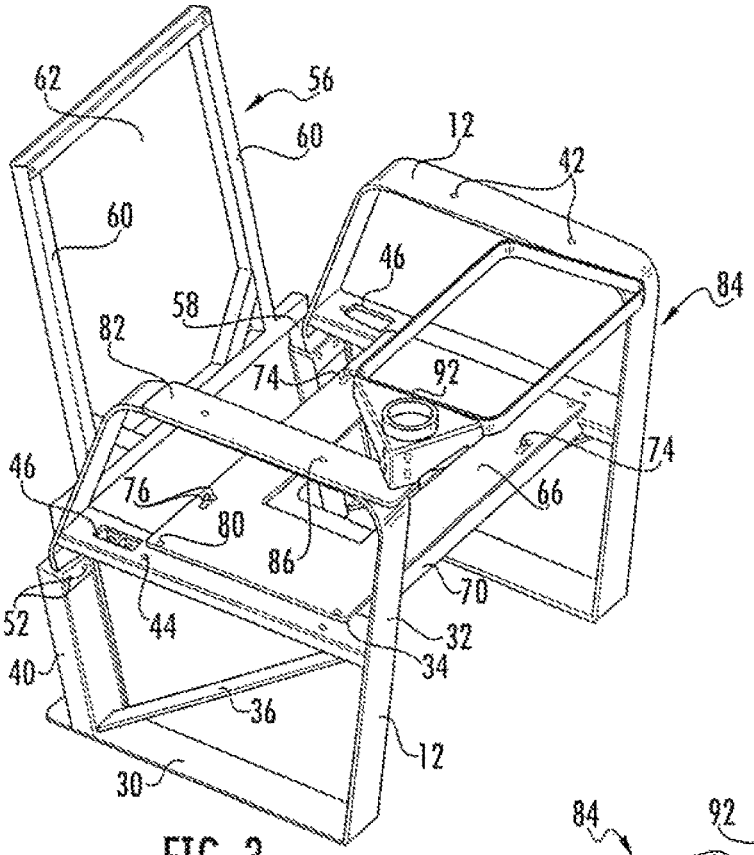
FIGS. 3 and 4 are perspective views of the modular seating unit of FIG. 1, with cushions removed.
Figure 4:
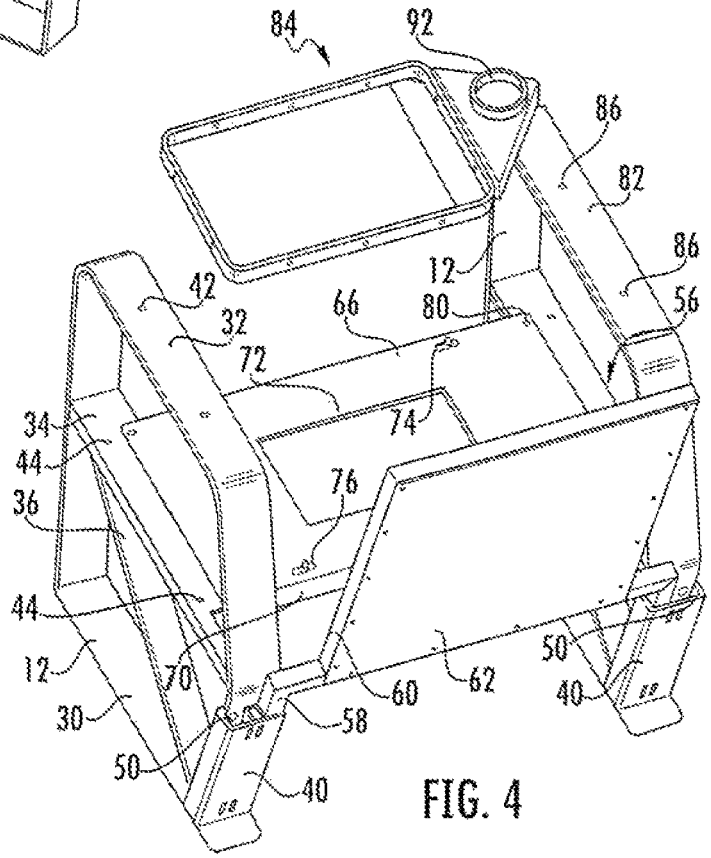

Referring to FIGS. 1, 3 and 4, each of the side frames 12 is substantially identical, and includes a base member 30 and an arm member 32 standing upwardly from the base member 30. A cross member 34 extends between the front and rear sides of the arm member 32 at the level of the seat bottom assembly 16, with a diagonal cross brace 36 extending from a lower, rear end of the arm member 32 to a front end of the cross member 34. A back assembly channel bracket 40 is formed on the rear side of the arm member 32 below the cross member 34. The side frames 12 are preferably of welded metal construction, with aluminum being preferred for low weight.

Where the back assembly channel bracket 40 extends from the arm member 32, the arm member 32 and bracket 40 are preferably rearwardly inclined relative to the base member 30 to give a comfortable rearward incline to the seat back assembly 14. For enhanced stability, the base member 30 extends rearwardly past the rear junction with the arm member 32. Advantageously, the base member 30 is dimensioned such that side frames 12 are stably freestanding when upwardly oriented.

An upper surface of the arm member 32 defines armrest mounting holes 42 for receiving the desk assembly 20 and/or armrest pads 22. The cross member 34 defines seat mounting holes 44 for receiving adjacent sides of the seat bottom assemblies 16 of adjacent seating units 10, as well as an power outlet mounting hole 46 for receiving either a power outlet or a blank cover.

The back assembly channel bracket 40 defines a pair of channels 50 for closely receiving adjacent sides of the seat back assemblies 14. A pair of locking member holes 52, preferably threaded, extend through the arm member 32 into upper ends of the respective channels 50. Locking members, preferably featuring complementary threads, are received in the holes 52 for releasably securing the adjacent sides of the seat back assemblies 14 into the channels 50.

Each seat back assembly 14 includes a back cushion 54 mounted to a back frame 56. While a cover of the back cushion 54 can be removed and replaced, the back cushion 54 preferably remains mounted to the back frame 56 when the modular seating unit 10 is disassembled. The padding of the back cushion 54 is advantageously a viscoelastic polyurethane "memory" foam. Customized covers can readily be used for all or a portion of seat back assemblies 14 in a given installation. Where an exhibitor or other user will have multiple events, groups of seat back assemblies 14 with custom covers could be reserved for repeated use.

The back frame 56 includes lower frame legs 58 and upper frame legs 60. The lower frame legs 58 are received in the channels 50 of the adjacent side frames 12. A back plate 62 is received over and extends between the upper frame legs 60 and provides additional support for the back cushion 54. Advantageously, the lower and upper frame legs 60 can be made of aluminum, like the side frames 12, while the back plate 62 is made of a ferromagnetic metal. This allows panels for advertising or other purposes to be releasably, magnetically attached to the rear of the of the seat back assembly 14.

The seat bottom assembly 16 includes a seat bottom cushion 64 and a seat pan 66. The seat bottom cushion 64, with padding advantageously made of memory foam like that the seat back cushion 54, is preferably removed therefrom during disassembly of the seating unit 10, and has a solid base underneath the padding.

The seat pan 66 is preferably made of a sheet of stamped metal to include front and rear lips 70 for enhanced rigidity and a central opening 72 for reduced weight. Seat bottom posts 74 extend upwardly from the seat pan 66 and are received in holes in the solid base of the seat bottom cushion 64 for proper alignment and retention thereof. Stacking holes 76 extend through the seat pan 66 on either side of the posts 74 to permit staggered stacking of seat pans 66 when disassembled. To further facilitate this stacking, the lips 70 are both angled somewhat outwardly from vertical. Side frame posts 80 extend downwardly from each edge of the seat pan 66 for reception in the seat mounting holes 44 of adjacent side frames 12. Additional stacking holes can be provided inwardly of the side frame posts 80 to further facilitate staggered stacking.

Each desk assembly 20 includes a mounting plate 82 and a desk 84. The mounting plate 82 is sandwiched between the upper surface of the arm member 32 of a side frame 12 and an armrest pad 22. Desk mounting holes 86 in the mounting plate 82 allow posts on the armrest pad 22 to extend therethrough into the armrest mounting holes 42 of the arm member 32. Nuts or other releasable locking mechanisms engage the posts of the armrest pad 22 under the upper surface of the arm member 32 to ensure a secure connection. A pivot post 90 extends upwardly from the forward end of the mounting plate 82 to pivotably receive the desk 84.

The desk 84 includes a pivot bearing in which the post 90 is received, along with a cup holder 92 and writing surface 94. Advantageously, the cup holder 92 is proximate to the pivot axis of the post 90 and bearing, such that pivoting of the desk 84 when rising or sitting results in minimal movement of a cup located therein.

In use, referring to FIGS. 1-4, the disassembled modular seating units 10 are stored in groups of side frames 12, seat back assemblies 14 (with back cushions 54 attached), seat bottom cushions 64 and seat pans 66. These groups could be stored on carts or the like for ease of transport. If desk assemblies 20 are desired for a particular use of the units 10, then the mounting plates 82 can be preinstalled on the side frames 12 (not including the last side frame of a given row), with the desks 84 stored separately. Depending on a desired number and configuration of seating units 10, a predetermined number of groups of components are selected and transported to the event venue.

The freestanding side frames 12 are set up in a spaced relationship and the lower frame legs 58 of the seat back assemblies 14 are inserted into the channels 50 of the back assembly channel brackets 40 of the side frames 12 and firmly secured in place by tightening the locking members inserted in the locking member holes 52. This gives a significant rigidity to each modular seating unit 10.

Seat pans 66 are then installed by inserting the side frame posts 80 into the seat mounting holes 44 of the cross members 34, and seat bottom cushions 64 are installed onto the seat bottom posts 74. If included, the desks 84 are attached to the pivot posts 90 of the mounting plates 82. If power outlets are installed in the cross members 34, extensions cords with branches for each seat can be run behind each row 24.

When the modular seating units 10 are no longer required, they are disassembled and removed in essentially opposite the order described above. It will be appreciated that a modular seating system including modular seating units according to the present invention allows for the very quickly assembly of comfortable, high-quality seating—comparable or better in comfort and appearance to permanently installed theater seating—while breaking down into relatively compact groups for transportation and storage.

Rental companies offering event seating often keep large numbers of seats pre-staged near large cities and other prominent convention locations. Since customized parts (like seat back assemblies) are a distinct and readily separable component, these components could be shipped at much lower cost than the entire seat and used with stock components in multiple locations for the same customer.

Figure 5:
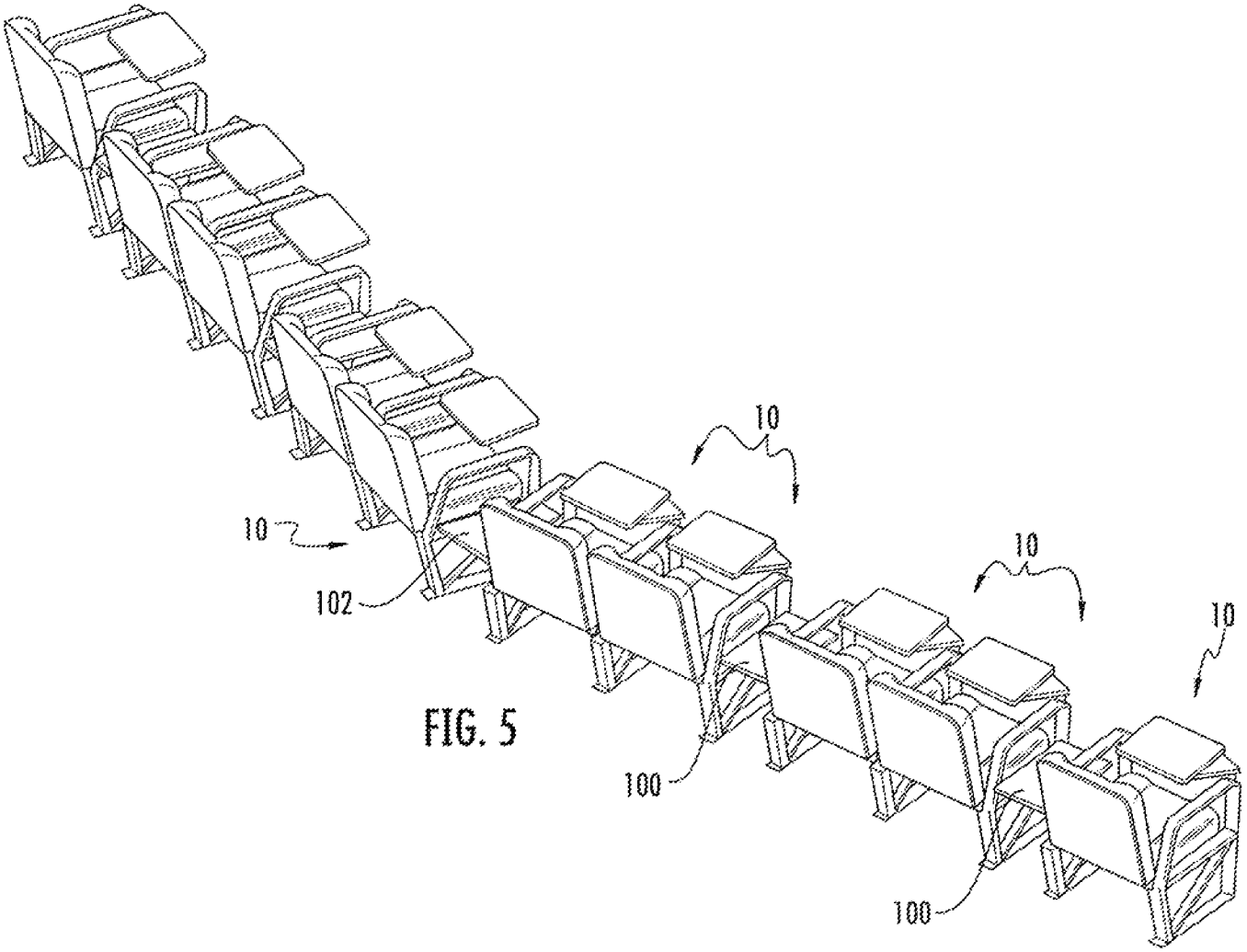
FIG. 5 is a perspective view of an alternate row of modular seating formed with the modular seating unit of FIG. 1.

Referring to FIG. 5, additional accessories are readily combined with the modular seating units 10 to allow very dynamic seating layouts. For instance, to achieve greater spacing and convenience, straight side desks 100 could be inserted between groups of units 10. Angled side desks 102 could be used to the same effect, as well as to create predictably angled rows 24A, allowing a seating configuration better focusing attendees on the sides of a room or other space to be better oriented toward a podium, stage or other presentation location. Advantageously, both straight and angled side desks 100, 102 are connected using the seat mounting holes 44 of adjacent cross members 34.

The foregoing is provided for illustrative and exemplary purposes; the present invention is not necessarily limited thereto. Rather, those skilled in the art will appreciate that various modifications, as well as adaptations to particular circumstances, are possible within the scope of the invention as herein shown and described.

What is claimed is:

1. A modular seating system comprising:

first, second and third side frames, each of the side frames including:

a base member configured to support the side frame on an underlying surface; and an arm member extending upwardly from the base member;

first and second seat back assemblies releasably connected to the first and second side frames and the second and third side frames, respectively; and first and second seat bottom assemblies releasably connected to the first and second side frames and the second and third side frames, respectively;

wherein each of the side frames further includes a back assembly channel bracket on a rear side of the arm member and each of the seat back assemblies includes first and second lower frame legs, the first and second lower frame legs of the first seat back assembly being releasably received in the back assembly channel brackets of the first and second side frames, respectively, and the first and second lower frame legs of the second seat back assembly being releasably received in the back assembly channel brackets of the second and third side frames, respectively;

wherein the back assembly channel bracket of each of the side frames defines first and second channels; and wherein the arm member of each of the side frames defines first and second locking member holes extending therethrough into upper ends of the first and second channels, respectively.

2. The modular seating system of claim 1, wherein the back assembly channel bracket of each of the side frames is rearwardly inclined relative to the base member such that the seat back assemblies releasably connected thereto are also rearwardly inclined.

3. The modular seating system of claim 2, wherein the base member of each of the side frames extends rearwardly past a rear junction with the arm member.

4. The modular seating system of claim 1, wherein each of the back assemblies includes a back cushion mounted to a back frame.

5. The modular seating system of claim 4, wherein a cover of the back cushion is removable while padding of the back cushion remains mounted to the back frame.

6. The modular seating system of claim 4, wherein the back frame includes first and second upper frame legs and a back plate extending therebetween behind the back cushion.

7. The modular seating system of claim 6, wherein the back plate is made of a ferromagnetic material allowing interchangeable panels to be magnetically attached to a rear of each of the seat back assemblies.

8. The modular seating system of claim 1, wherein each of the seat bottom assemblies includes a seat pan with a seat bottom cushion releasably mounted thereto, opposite sides of the seat pan of the first seat bottom assembly being releasably connected to the first and second side frames, respectively, and opposite sides of the seat pan of the second seat bottom assembly being releasably connected to the second and third side frames, respectively.

9. The modular seating system of claim 8, wherein each of the side frames includes a cross member extending between front and rear sides of the arm member below an upper surface thereof, the opposite sides of the seat pan of the first seat bottom assembly being releasably connected to the cross members of the first and second side frames, respectively, and opposite sides of the seat pan of the second seat bottom assembly being releasably connected to the cross members of the second and third side frames, respectively.

10. The modular seating system of claim 1, further comprising first, second and third armrest pads releasably connected to the upper surfaces of the arm members of the first, second and third side frames, respectively.

11. The modular seating system of claim 10, further comprising first and second desk assemblies releasably connected to the upper surfaces of the arm members of the first and second side frames, respectively.

12. The modular seating system of claim 11, wherein each of the desk assemblies includes a mounting plate mounted between the upper surface of the arm member and the armrest pad and a desk pivotably connected to the mounting plate.

13. The modular seating system of claim 1, further comprising:

fourth and fifth side frames substantially identical to the first, second and third side frames;

a side desk releasably connected to the third and fourth side frames;

a third seat back assembly substantially identical to the first and second seat back assemblies and releasably connected to the fourth and fifth side frames; and a third seat bottom assembly substantially identical to the first and second seat bottom assemblies and releasably connected to the fourth and fifth side frames.

14. The modular seating assembly of claim 13, wherein the side desk is angled such that a direction faced by seats formed between the first, second and third side frames is offset from a direction faced by seats formed between the fourth and fifth side frames.

15. The modular seating system of claim 1, wherein the first and second locking member holes are threaded to receive threaded locking members.

16. The modular seating system of claim 1, wherein each of the side frames is configured to be freestanding on the underlying surface, independently of connection with the seat back assemblies and seat bottom assemblies.

17. A modular seating system comprising:

first, second and third side frames, each of the side frames including:

a base member configured to support the side frame on an underlying surface; and an arm member extending upwardly from the base member;

first and second seat back assemblies releasably connected to the first and second side frames and the second and third side frames, respectively; and first and second seat bottom assemblies releasably connected to the first and second side frames and the second and third side frames, respectively;

wherein each of the back assemblies includes a back cushion mounted to a back frame;

wherein the back frame includes first and second upper frame legs and a back plate extending therebetween behind the back cushion; and wherein the back plate is made of a ferromagnetic material allowing interchangeable panels to be magnetically attached to a rear of each of the seat back assemblies.

* * * * *